US006227895B1

(12) United States Patent
Mc Farlane

(10) Patent No.: US 6,227,895 B1
(45) Date of Patent: May 8, 2001

(54) CONNECTOR SYSTEM

(75) Inventor: Glen Mc Farlane, Bicester (GB)

(73) Assignee: Intertemo Holding S.A. (CH)

( * ) Notice: Subject to any disclaimer, the term of this patent is extended or adjusted under 35 U.S.C. 154(b) by 0 days.

(21) Appl. No.: 09/421,129

(22) Filed: Oct. 19, 1999

(51) Int. Cl.[7] ..... H01R 13/627
(52) U.S. Cl. ..... 439/352; 439/353
(58) Field of Search ..... 439/350–358

(56) References Cited

U.S. PATENT DOCUMENTS

| | | | | |
|---|---|---|---|---|
| 4,526,431 | * | 7/1985 | Kasukawa | 439/352 |
| 4,915,642 | * | 4/1990 | Liu et al. | 439/352 |
| 4,929,189 | * | 5/1990 | Sekiguchi | 439/352 |
| 5,195,905 | | 3/1993 | Pesci | 439/352 |
| 5,580,268 | * | 12/1996 | Miyazawa | 439/352 |
| 5,637,010 | * | 6/1997 | Jost et al. | 439/352 |

FOREIGN PATENT DOCUMENTS

| | | |
|---|---|---|
| 2 063 258 | 7/1971 | (DE) . |
| 0 450 909 | 10/1991 | (EP) . |
| 2 155 703 | 9/1985 | (GB) . |

* cited by examiner

*Primary Examiner*—Hien Vu
(74) *Attorney, Agent, or Firm*—Anthony J. Casella; Gerald E. Hespos; Michael J. Porco

(57) ABSTRACT

A connector unit 1 comprises a latching shell 3 having three peripheral resilient tongues 4 at substantially 120° from one another each bearing an outwardly projecting latch 5. A catching sleeve 28 also arranged in the connector unit 1 has three peripheral arms 30 at substantially 120° from one another each provided with an inner latch catching groove 31. The peripheral arms 30 of the catching sleeve 28 are located angularly between the resilient tongues 4 of the latching shell 3, whereby the latches 5 are circumferentially alternating with the latch catching grooves 31.

10 Claims, 6 Drawing Sheets

CONNECTOR SYSTEM

TECHNICAL FIELD

This invention relates to a connector system for coupling signal transmission conductor means via mating means controlled by a self-latching mechanism.

BACKGROUND ART

Connector systems of this type are known and universally used in various areas demanding very good qualities of precision and reliability.

General configurations of these systems comprise two tubular bodies forming a plug and socket arrangement, each of these plug and socket bodies being intended to be coupled to conductors for the transmission of electric, photonic or fluid signals, and the plug and socket bodies being for engagement into one another. Upon insertion of the plug body into the socket body a self-latching mechanism automatically locks the plug body in the socket body by mere pushing the plug body axially into the socket body. When required, the plug body is disengaged from the socket body by a straight axial pull on an outer release sleeve which initially allows unlocking of the self-latching mechanism and then withdrawal of the plug body out of the socket body. Accordingly, the connection between plug body and socket body cannot be broken by pulling on the cable containing the signal transmission conductors or any other component part of the plug and socket bodies other than the outer release sleeve.

In a well known of these connector systems, a plurality of peripheral elastic tongues are mounted on the plug body and each of said tongues bears on outwardly projecting latch whereby each said latches may resiliently move radially on the plug body. An outer sleeve slidably mounted on the plug body for axial movement therealong comprises an extension surrounding the peripheral elastic tongues and this extension has a plurality of transverse windows respectively placed over the projecting latches, whereby axial movement of the sleeve over the plug body causes the windows of the sleeve extension to act as ramps forcing the projecting latches radially and inwardly with respect to the plug body. The socket body comprises an inner circular groove for catching the projecting latches upon insertion of the plug body into the socket body. According to the general operation described hereabove, connection of the system is obtained by mere insertion of the plug body into the socket body, whereby the projecting latches radially contract to enter into the socket body and then expand into the catching groove thereof, thus locking the assembly of plug body and socket body. Disconnection of the system is obtained by axial pull on the outer sleeve the windows of which radially contract the projecting latches thereby allowing extraction thereof from the catching groove whereby the plug body may be withdrawn from the socket body.

Another of these connector systems, described in U.S. Pat. No. 3,160,457, comprises a plurality of peripheral elastic tongues with protruding latches mounted on a release sleeve slidably arranged over the plug body which carries a truncated cone ramp disposed under the latches. A release space is provided between the latches and the plug body. The socket body comprises an inner circular groove for catching the protruding latches upon insertion of the plug body into the socket body. Connection of the system is obtained by pushing the plug body into the socket body whereby the latches may contract in the release space and enter into the socket body and then expand into the catching groove. In that configuration, any pull on the plug body other than on the release sleeve results in the truncated cone ramp of the plug body further urging the latches in the catching groove of the socket body. Disconnection of the self-latching assembly is obtained by pulling the release sleeve whereby the latches may contract in the release space to allow withdrawal of the plug body from the socket body.

Still a further of these connector systems is described in FR-A-2159701. A plug body comprises a plurality of peripheral elastic tongues with inwardly projecting latches intended to engage an annular catching groove peripherally arranged on a socket body. A release sleeve is mounted for movement over the plug body and comprises at one end a bevelled portion orientated towards the inwardly projecting latches and capable of passing beneath them, and at the other end, a stop arrangement cooperating with a circlip mounted elastically on the plug member. The internal surface of the release sleeve is staged so as to block the inwardly projecting latches in the catching groove of the socket body when the stop arrangement is engaged on the circlip and to allow the latches to expand radially out of the catching groove when the stop arrangement is released from the circlip, which allows the bevelled portion of the release sleeve to pass beneath the latches to spread them radially apart and unlock the self-latching connection.

All these connector systems are definitely fail-proof with operators who know or can recognise that they have in hands a plug body or a socket body that are made to fit to one another whereby the connection can be secured either by inserting the plug body into the socket body or by engaging the socket body over the plug body. However, this is not necessarily the case in high stress or so-called blind conditions such as exist, for example, in military operation. A fail-proof connection cannot be assured if the operator may be puzzled by having in hand the plug body or the socket body. And that situation may be particularly acute where connection has to be made on loose cables.

DISCLOSURE OF THE INVENTION

It is an object of this invention to avoid that failure potential by means of a connector system which avoids any puzzling condition for the operator, even under the worse environmental conditions. A further object of the invention is to achieve a connector system that simplifies logistics in the coupling of signal transmission conductor means. And a still further object of the invention is to propose a connector system that is versatile and easy to manufacture.

To this effect, the connector system according to the invention complies with the definitions given in the claims.

Accordingly, a connector unit comprising resiliently movable latch means circumferentially alternating with latch catching means allows mating of a first connector unit with a second identical connector unit by mere insertion and self-latching of the resiliently movable latch means of the first connector unit into the latch catching means of the second connector unit while the latch catching means of the first connector unit simultaneously house and catch the resiliently movable latch means of the second connector unit. There are no hazardous or search manipulations of different elements and no questions about what has to be done with elements which differ visually, tactily or operatively. A simple fail-proof one motion insertion is only required to achieve the coupling of the signal transmission conductor means. As the connector unit acts both as a plug body and a socket body, logistics are simplified either for the types of elements that have to be stored or in the preparation of cable assemblies. Tutoring of operators is drastically reduced, whatever their educational background. And manufacture of the connector system is also simplified by the reduction of the number of different elements.

In a preferred embodiment, the connector unit comprises a plurality of resiliently movable latch means circumferentially arranged at a distance from one another and a plurality of latch catching means circumferentially alternating with said latch means, whereby a still further ease of coupling is achieved. And the latch means may be movable radially or circumferentially.

Where ramp means are provided for urging the latch means against the resiliency thereof, unmating becomes effortless as the latching means are released from the latch catching means.

Where a control sleeve is mounted for longitudinal movement on the connector unit, with the ramp means connected to the control sleeve, self-latching and release of the connection may be achieved by direct push-pull action on the control sleeve. A control sleeve may also be mounted for longitudinal movement on the connector unit, with the latch means connected to the control sleeve.

Wall means may be provided for urging the latch means in latching condition to strengthen the locking condition of the latch means in the latch catching means.

And spring biased muff means may be mounted in the connector unit to reciprocate over the latch means and latch catching means for tightness purposes and/or to prevent unwanted contact with the signal transmission conductor means in the connector unit and/or to protect the latch means and latch catching means from environmental aggression.

BRIEF DESCRIPTION OF DRAWINGS

These and other objects, features and advantages of the invention will become readily apparent from the following detailed description With reference to the accompanying drawings which show, diagrammatically and by way of example only, two preferred but still illustrative embodiments of the invention.

MODES OF CARRYING OUT THE INVENTION

Figure 1:
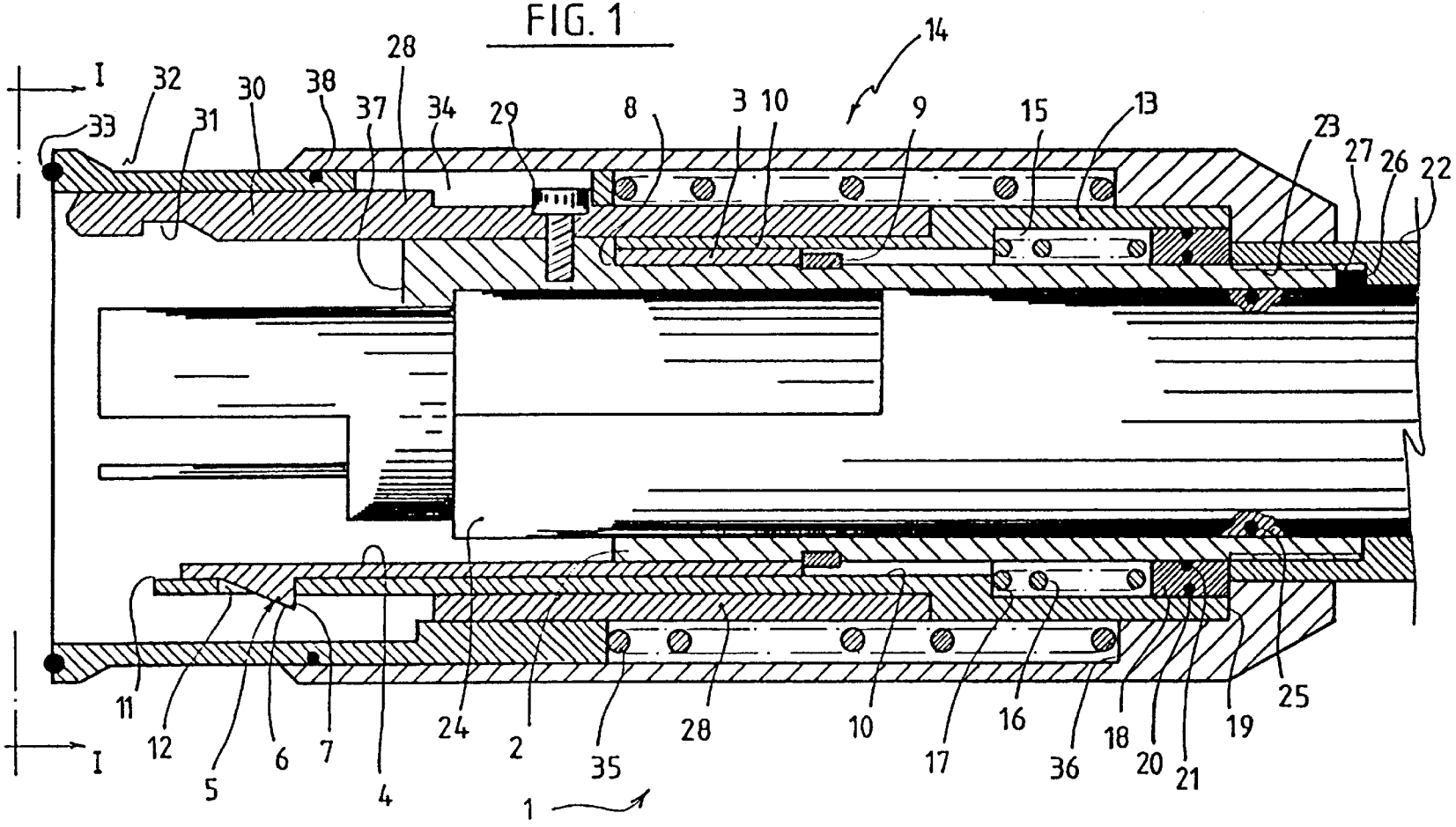
FIG. 1 is a longitudinal section of the connector unit of the first embodiment of the invention.
Figure 2:
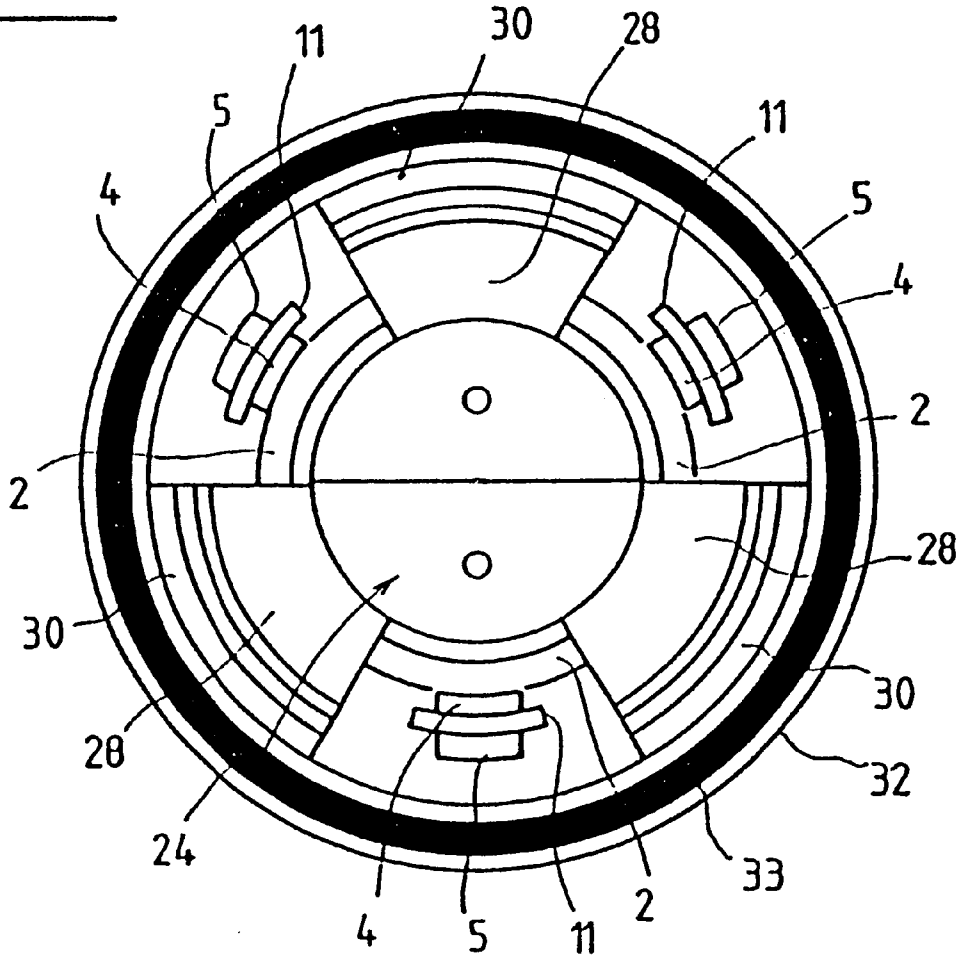
FIG. 2 is a view according to line I—I of FIG. 1.
Figures 3, 4, 5, 6, 7, 8, 9, 10:
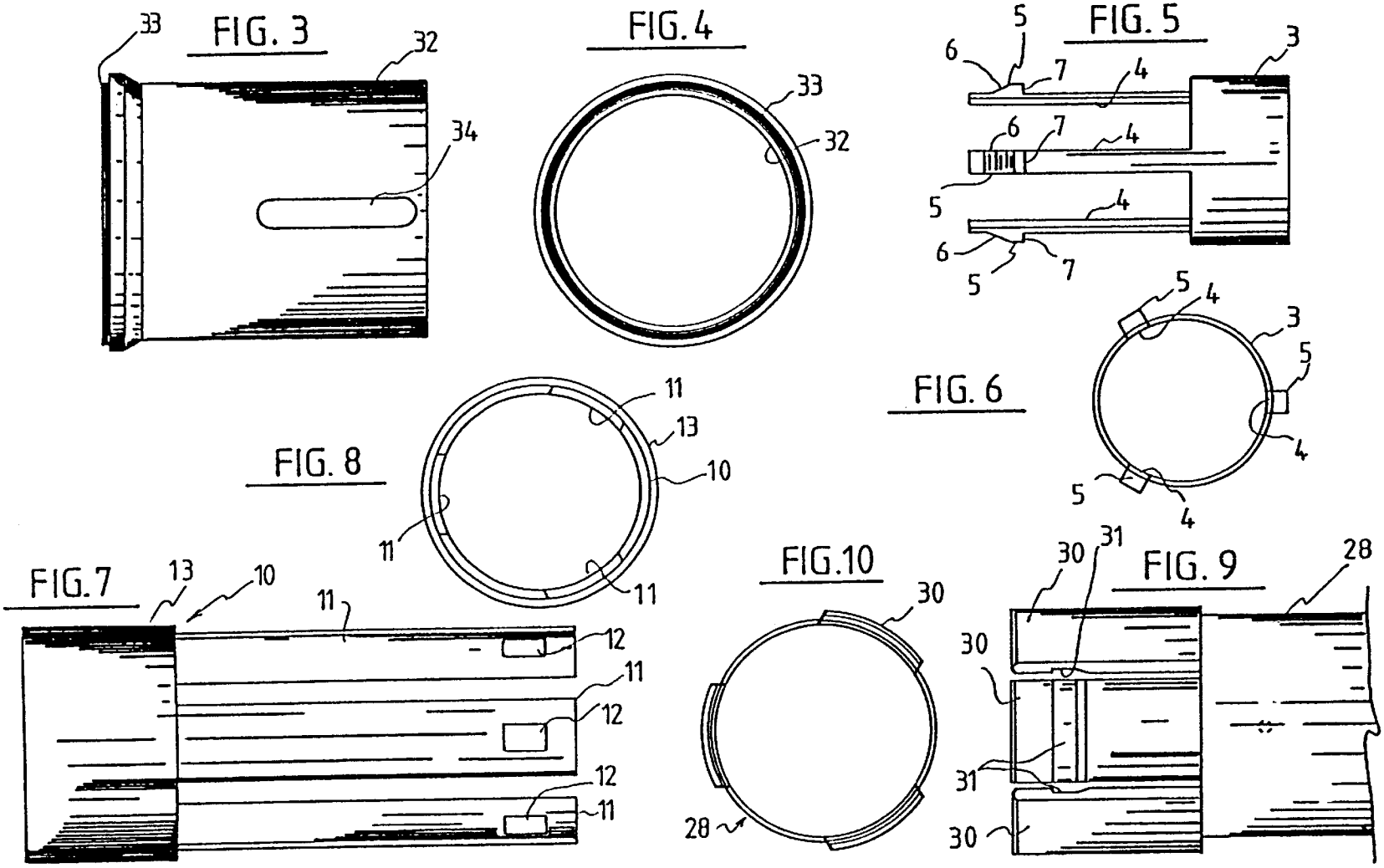
FIGS. 3 and 4, 5 and 6, 7 and 8, 9 and 10, are respectively side elevations and top plan views of details of FIG. 1.

The connector unit 1 shown in FIGS. 1 and 2 comprises a central tubular body 2 on which is mounted a latching shell 3 (FIGS. 1, 2, 5, 6) having three peripheral resilient tongues 4 extending at 120° from one another, each bearing at its end an outwardly projecting latch 5 having a forward surfaces inclined towards the end of the tongue 4 and a rearward abutment surface 7 substantially perpendicular to the tongue 4. Latching shell 3 is affixed to the central tubular body 2 between a shoulder 8 thereof and a ring 9 fastened thereto.

Over latching shell 3 is a slidable sleeve 10 (FIGS. 1, 2, 7, 8) having at one end three peripheral extension arms 11 arranged at substantially 120° from one another over the tongues 4 of latching shell 3. Each arm 11 is provided with a transverse window 12 located over the corresponding latch 5. The sleeve 10 abuts against shoulder 8 of central tubular body 2 and its rear end 13 is fastened for example glued, to a control sleeve 14 surrounding the connector unit 1. Inside the rear end 13 of sleeve 10 is a chamber 15 in which is located a coil spring 16 of which one end abuts against a wall 17 of chamber 15 and the other end abuts against a ring 18 movable in chamber 15 and the rear end of which bears against an abutment wall 19 of the rear end of control sleeve 14. Two O-rings 20 and 21 on ring 18 assure tightness between ring 18, sleeve 10 and central tubular body 2.

The rear end of control sleeve 14 slidingly bears on the end of a collet nut 22 meshing on a threaded end portion 23 of central tubular body 2 and bearing against the rear end of ring 18. Collet nut 22 holds a signal transmission conductor assembly 24 extending in central tubular body 2 and abuting against a shoulder 37 thereof. An O-ring 25 assures tightness between signal transmission conductor assembly 24 and central tubular body 2. Signal transmission conductor assembly 24 is secured angularly to central tubular body 2 via a stud 26 positioned in a groove 27 of central tubular body. Signal transmission conductor assembly 24 can be of any kind for transmitting electric, photonic or fluid signals, and needs no further description.

Over the sleeve 10 and central tubular body 2 is mounted a catching sleeve 28 (FIGS. 1, 2, 9, 10) affixed to central tubular body 2 by a screw 29. Catching sleeve 28 comprises three peripheral arms 30 arranged at substantially 120° from one another and located angularly between resilient tongues 4 of latching shell 3 and windowed arms 11 of sleeve 10, and each peripheral arm 30 is provided with an inner latch catching groove 31 having substantially the same shape as latches 5, however in reversed condition. The latches 5 and windows 12 are thus circumferentially alternating with the latch catching grooves 31.

The front end of control sleeve 14 extends somewhat back of the front end of peripheral arms 30 of catching sleeve 28 and between catching sleeve 28 and control sleeve 14 is mounted a sliding muff 32 (FIGS. 1, 2, 3, 4) the front end of which contains an O-ring 33. The rear end of muff 32 is slotted at 34 for longitudinal positioning and angular guiding by screw 29, and a spring 35 located between the rear end of muff 32 and an inner abutment wall 36 of control sleeve 14 urges forwardly muff 32 over the front end of the peripheral arms 30 of catching sleeve and the latches 5 of latching shell 3. An O-ring 38 assures tightness between muff 32 and control sleeve 14.

Figure 11:
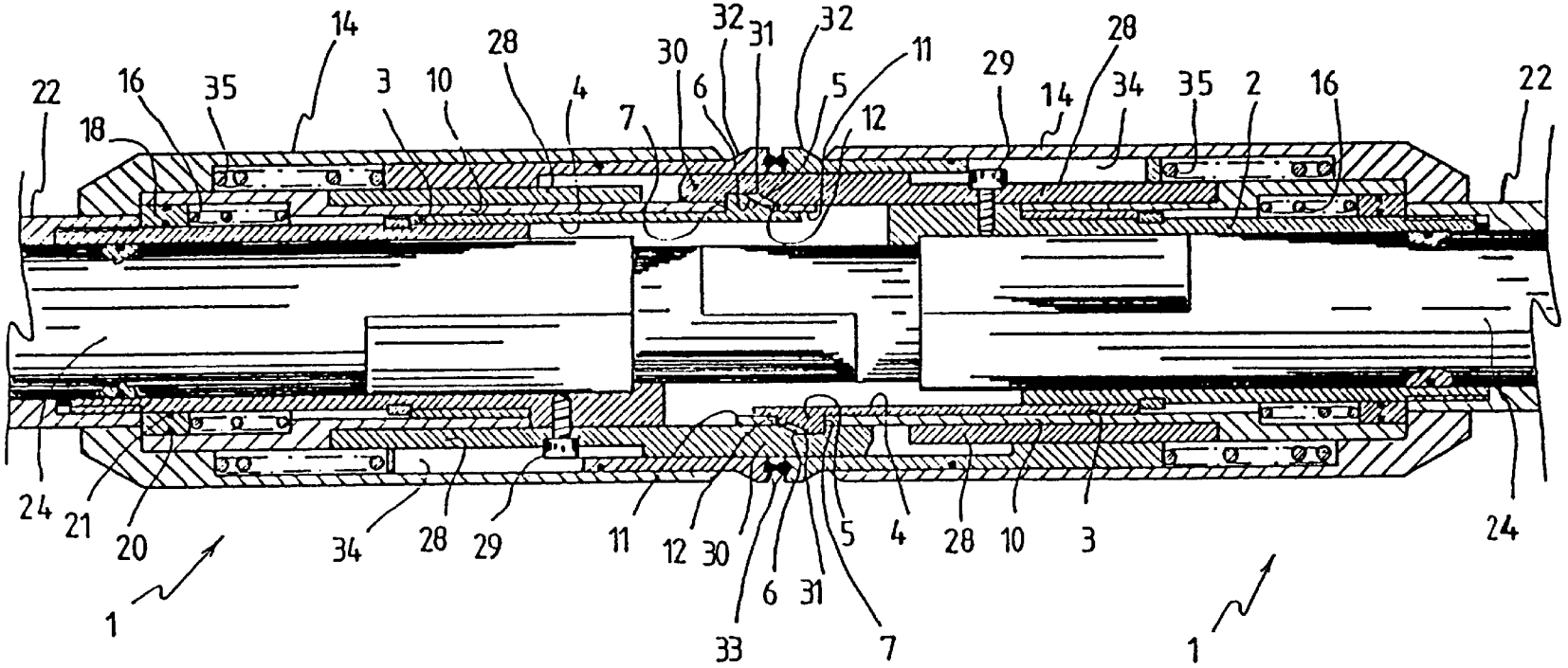
FIG. 11 is a longitudinal section showing the connector unit of the first embodiment in mating condition with an identical connector unit.

Operation of this connector unit is as follows, reference being made to FIG. 11. Two identical connector units 1 are positioned in front of one another and pushed against one another and the O-rings 33 of muffs 32 assure tightness at that location. The muffs 32 retract within the control sleeves 14, against the bias of springs 35, whereby the peripheral arms 30 of the catching sleeve 28 of each of the connector units 1 may be respectively inserted between the peripheral arms 30 of the catching sleeve 28 of the other connector unit. The latches 5 and windows 12 of latching shell 3 and sleeve 10 of each connector unit 1 may thus respectively engage under the peripheral arms 30 of the catching sleeve 28 of the other connector unit 1. Due to the bias of resilient tongues 4, the latches 5 engage the corresponding latch catching grooves 31 with their rearward abutment 7 bearing against the corresponding reversed shape of the latch catching groove 31. The assembly of the two connector units 1 is thus secured and tight. Any pull on the collet nuts 22 or on the cables (not shown) connected to the signal transmission conductor assemblies 24 is transmitted to the latches 5 and latch catching grooves 31 via central tubular bodies 2, latching shells 3, resilient tongues 4, and screws 29, and the assembly of the connector units I remains firmly secured.

Disassembly is achieved by mere pull on one or both the control sleeves 14 of the connector units 1 which retract against the bias of springs 16. Retraction of control sleeve 14 against the bias of spring 16 draws sleeve 10 the extension arms 11 of which drive the windows 12 along inclined surfaces 6 of latches 5 thereby urging latches 5 out of the latch catching grooves 31. The connector units 1 may thus be separated from one another while muffs 32 are pushed by springs 35 over the latches 5 and peripheral arms 30 of catching sleeves 28 and the end of the signal transmission conductor assemblies 24.

Figure 12:
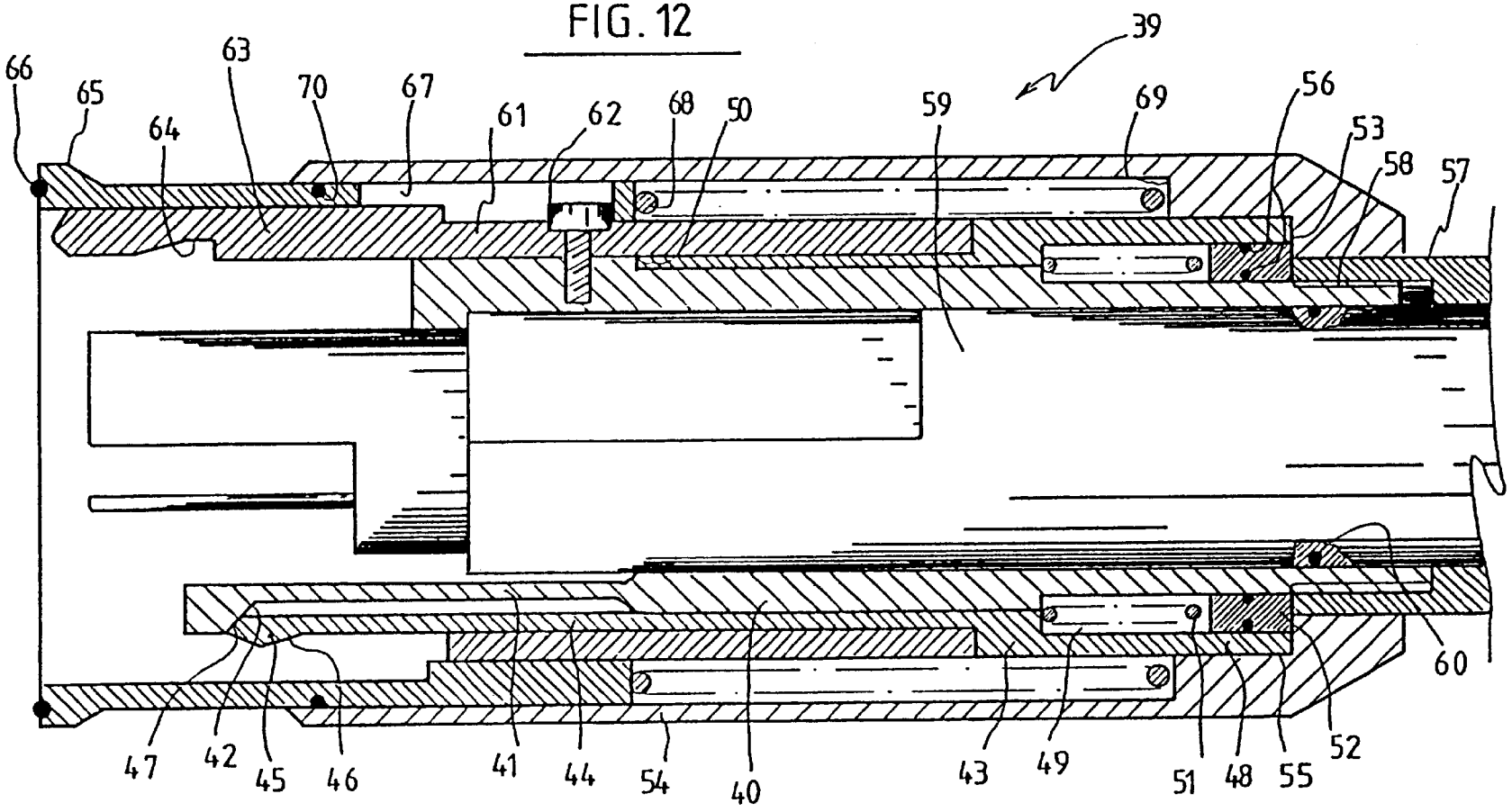
FIG. 12 is a longitudinal section of the second embodiment of the invention.

The second embodiment shown in FIG. 12 comprises a connector unit 39 having a central tubular body 40 with three peripheral arms 41 extending at 120° from one another, each terminating in an upwardly inclined wall 42. Over the central tubular body 40 is slidably mounted a latching shell 43 having three peripheral resilient tongues 44 respectively extending at 120° from one another at some distance over the arms 41. Latching shell 43 is limited in its forward motion by a shoulder 50 of central tubular body 40 and it is angularly fixed with respect to central tubular body 40 via a stud and groove arrangement (not shown). Resilient tongues 44 terminate each in an outwardly projecting latch 45 having a rearward latching surface 46 and a front inwardly oriented surface 47 bearing on inclined wall 42 of arm 41. Rearward portion 48 of latching shell 43 includes a chamber 49 in which is located a coil spring 51 of which one end abuts against the front wall of chamber 49 and the other end abuts against a ring 52 movable in chamber 49 and over central tubular body 40. The rear end of ring 52 bears against an abutment wall 53 of the rear end of a control sleeve 54 surrounding the connector unit 39 and affixed, for example glued, at 55 to latching shell 43. Two O-rings 56 on ring 52 provide tightness between ring 52, latching shell 43 and central tubular body 40.

The rear end of control sleeve 54 slidingly bears on the end of a collet nut 57 meshing on a threaded end portion 58 of central tubular body 40 and bearing against the rear end of ring 52. Collet nut 57 holds a signal transmission conductor assembly 59 extending and secured longitudinally and angularly in central tubular body 40 as that of the first embodiment. An O-ring 60 provides tightness between signal transmission conductor assembly 59 and central tubular body 40.

Over the latching shell 43 and the central tubular body 40 is mounted a catching sleeve 61 affixed to central tubular body 40 via a screw 62. Catching sleeve 61 comprises three peripheral arms 63 arranged at substantially 120° from one another and located angularly between resilient tongues 44 of latching shell 43 and peripheral arms 41 of central tubular body 40. Each peripheral arm 63 of catching sleeve 61 is provided with an inner latch catching groove 64 having substantially the same shape as latches 45 however in reversed arrangement. The latches 45 and arms 41 are thus circumferentially alternating with the latch catching grooves 64.

The front end of control sleeve 54 extends somewhat back of the front end of peripheral arms 63 of catching sleeve 61 and between catching sleeve 61 and control sleeve 54 is mounted a sliding muff 65 the front end of which contains an O-ring 66. The rear end of muff 65 is slotted at 67 for longitudinal and angular positioning by screw 62, and a spring 68 positioned between the rear end of muff 65 and an inner abutment wall 69 of control sleeve 54 urges forwardly muff 65 over the front end of peripheral arms 63 of catching sleeve 61 and the latches 45 and arms 41. An O-ring 70 assures tightness between muff 65 and control sleeve 54.

Figure 13:
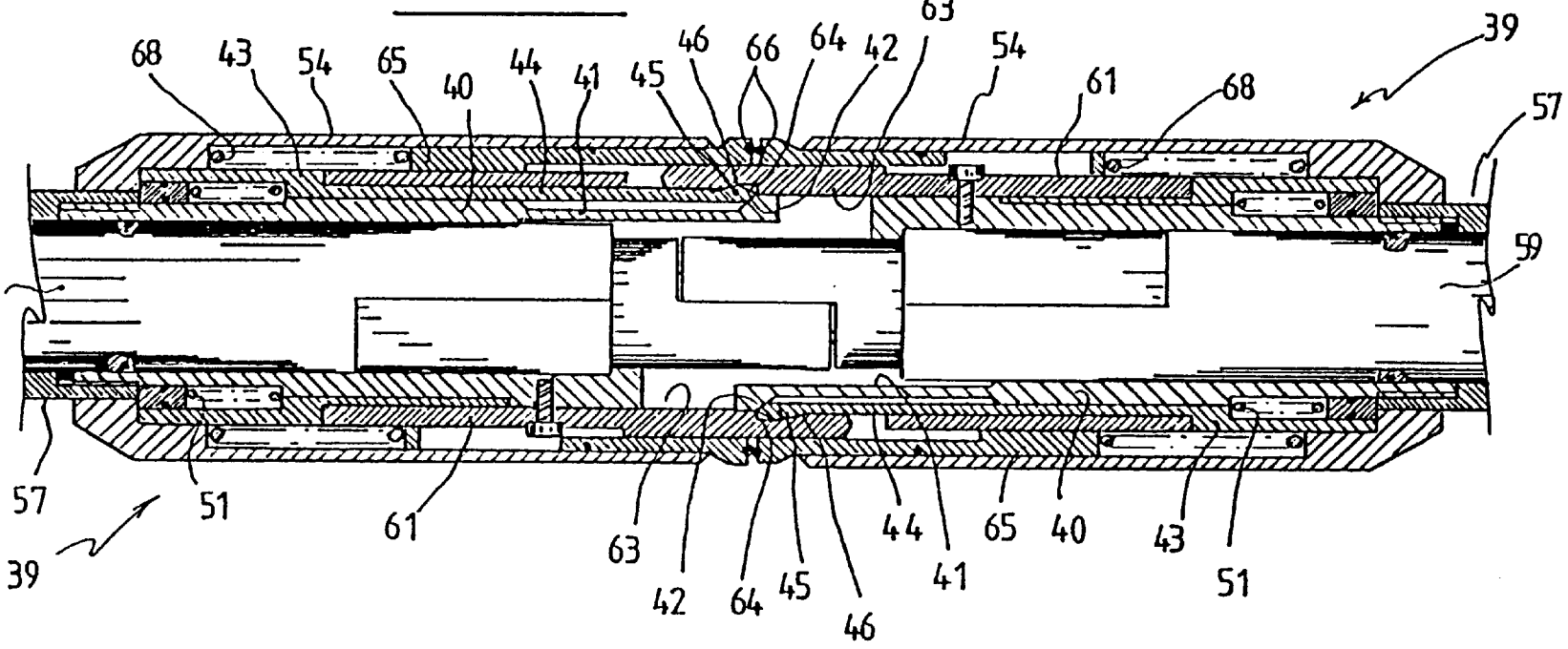
FIG. 13 is a longitudinal section showing the connector unit of the second embodiment in mating condition with an identical connector unit.

Operation of this embodiment is as follows with reference to FIG. 13. Two identical connector units 39 are positioned in front of one another and pushed against one another, whereas the O-rings 66 assure tightness at that level. The muffs 65 retract within control sleeves 54 against the bias of springs 68, whereby the peripheral arms 63 of catching sleeve 61 of each of the connector units 39 may be respectively inserted between the peripheral arms 63 of the catching sleeve 61 of the other connector unit. The latches 45 and arms 41 of each connector unit 39 may thus respectively engage under the peripheral arms 63 of the other connector unit 39. Due to the bias of resilient tongues 44, the latches 45 engage the corresponding latch catching grooves 64 with their rearward latching surface 46 bearing against the corresponding surface of the latch catching groove 64. The assembly of the two connector units 39 is thus secured and tight. Any pull on the collet nuts 57 or on the cables (not shown) connected to the signal transmission conductor assemblies 59 is transmitted to the central tubular bodies 40 the peripheral arms 41 and inclined walls 42 of which urge the latches 45 into the latch catching grooves 64, and the assembly of the connector units 39 remains strongly secured. Disassembly is achieved by simple pull on one or both the control sleeves 54 of the connector units 39. Retraction of the control sleeve 54 against the bias of spring 51 draws latching shell 43 the latches 45 of which are urged out of the latch catching grooves 64 by the walls thereof and along inclined walls 42 or peripheral arms 41. The connector units may thus be separated from one another while muffs 65 are pushed by springs 68 over the latches 45 and peripheral arms 63 of catching sleeves 61 as well as the end of signal transmission conductor assemblies.

Variants are available.

For example, the number of latched tongues and latch catching arms and related elements may be less or more than three, being essential that they provide a circumferential alternation allowing intermating of the connector unit with an identical connector unit.

The latches may protrude inwardly with the corresponding re-arrangement of the related elements.

The latches may be resiliently movable circumferentially instead of radially as shown, the latch catching grooves, windowed arms and ramp equipped peripheral arms being correspondingly positioned to operate laterally.

The substantially triangular latches shown may have other shapes, and they may be replaced by balls.

The muff system 32, 65 can be suppressed, in particular where tightness or protection is not required for the latches and related elements, the latch catching elements, and the signal transmission conductor assemblies.

The muff 32, 65 may include a half-moon lid projecting forwardly of the front end thereof for further ease of mating.

What is claimed is:

1. A connector system for coupling a signal transmission conductor by a self-latching mechanism, comprising a connector unit (1) with a central tubular body (2) secured to a latching shell (3), said latching shell (3) having a plurality of resilient tongues (4) circumferentially arranged at equal distances from one another, each of said tongues (4) having a projecting latch (5), a catching sleeve (28) secured to said central tubular body (2) and having latch catches (31) circumferentially alternating with said projecting latches (5), a control sleeve (14) mounted for longitudinal movement on said connector unit (1), a slidable sleeve (10) slidably mounted on said latching shell (3), said sleeve (10) having at one end a plurality of peripheral extension arms (11) respectively extending along said tongues (4) each said extension arm (11) having ramp (12) for urging a corresponding one of said latches (5) against the resiliency thereof, said catching sleeve (28) comprising a plurality of peripheral arms (30) circumferentially arranged at equal distances from one another and located angularly between said tongues (4) and said extension arms (11), said peripheral arms (30) each having one of said latch catches (31), and said control sleeve (14) being fastened to said slidable sleeve (10), whereby self-latching and release of the connector unit (1) with a second identical connector unit is achieved by direct push-pull action on the control sleeve (14).

2. The connector system according to claim 1, wherein said tongues (4) and projecting latches (5) are movable radially.

3. The connector system according to claim 1, wherein said slidable sleeve (10) comprises a chamber (15), a spring (16) located in said chamber (15), said spring (16) having a first end abutting against a wall (17) of said chamber (15) and a second end abutting against a wall (19) of the control sleeve (14) and a part (22) of central tubular body (2).

4. The connector system according to claim 3, wherein said second end of the spring (16) abuts against a ring (18) that is movable in the chamber (15) and bears against said side wall (19) and said part (22) of central tubular body (2), and wherein two O-rings (20) and (21) are provided on the ring (18) assuring tightness between the ring (18), the sleeve (10) and the central tubular body (2).

5. The connector system according to claim 4, wherein said control sleeve (14) has a rear end slidingly bearing on the part (22) of the central tubular body (2).

6. A connector system for coupling signal transmission conductor (59) by a self-latching mechanism, comprising a connector unit (39) with a central tubular body (40) angularly secured to a latching shell (43), said latching shell (43) having a plurality of resilient tongues (44) circumferentially arranged at equal distances from one another, each of said tongues (44) having a projecting latch (45), a catching sleeve (61) secured to said central tubular body (40) and having latch catches (64) circumferentially alternating with said projecting latches (45), a control sleeve (54) mounted for longitudinal movement on said connector unit (39), said central tubular body (40) comprising a plurality of peripheral arms (41) respectively extending along said tongues (44), each said peripheral arm (41) having an inclined wall (42) for urging a corresponding latch (45) into said latch catches (64), said catching sleeve (61) comprising a plurality of peripheral arms (63) circumferentially arranged at equal distances from one another and located angularly between said tongues (44) and said peripheral arms (41) of the central tubular body (40), said peripheral arms (63) of the catching sleeve (61) each having one of said latch catches (64), said latching shell (43) being slidably mounted on said central tubular body (40), and said control sleeve (54) being fastened to said latching shell (43), whereby self-latching and release of the connector unit (39) with a second identical connector unit is achieved by direct push-pull action on the control sleeve (54).

7. The connector system according to claim 6, wherein said tongues (44) and projecting latches (45) are movable radially.

8. The connector system according to claim 6, wherein said latching shell (43) comprises a chamber (49), a spring (51) being located in the chamber (49), the spring (51) having a first end abutting against a wall of said chamber (49) and a second end abutting against a wall (53) of the control sleeve (54) and a part (57) of the central tubular body (40).

9. The connector system according to claim 8, wherein said second end of the spring (51) abuts against a ring (52) movable in the chamber (49) and bearing against said wall (53) and said part (57) of central tubular body (40), and two O-rings (56) being provided on the ring (52) for assuring tightness between the ring (52), the latching shell (43) and the central tubular body (40).

10. The connector system according to claim 9, wherein said control sleeve (54) has a rear end slidingly bearing on the part (57) of the central tubular body (40).

* * * * *

UNITED STATES PATENT AND TRADEMARK OFFICE

CERTIFICATE OF CORRECTION

PATENT NO. : 6,227,895 B1
DATED : May 8, 2001
INVENTOR(S) : Glen McFarlane

It is certified that error appears in the above-identified patent and that said Letters Patent is hereby corrected as shown below:

Title page,
Item [73], should read as follows:
-- (73) Assignee: Interlemo Holding S.A. (CH) --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,227,895 B1
DATED : May 8, 2001
INVENTOR(S) : Glen Mc Farlane

It is certified that error appears in the above-identified patent and that said Letters Patent is hereby corrected as shown below:

Title page,

| | |
|---|---|
| Item [22], PCT Filed: | Apr. 3, 1998 |
| Item [86], PCT No.: | PCT/EP98/01960 |
| § 371 Date: | Oct. 19, 1999 |
| § 102 (e) Date: | Oct. 19, 1999 |
| Item [87], PCT Pub. No.: | WO98/49753 |
| PCT Pub. Date: | Nov. 5, 1998 |

Item [30] Foreign Application Priority Data

Apr. 30, 1997 [EP] European Patent Office.....97107167.5

Signed and Sealed this

Twelfth Day of March, 2002

*Attest:*

*Attesting Officer*

JAMES E. ROGAN
*Director of the United States Patent and Trademark Office*